US008496195B2

(12) United States Patent
Sjoberg et al.

(10) Patent No.: US 8,496,195 B2
(45) Date of Patent: Jul. 30, 2013

(54) HYDRAULIC CIRCUIT AND METHOD FOR CONTROLLING A GYRATORY CONE CRUSHER

(75) Inventors: Patrik Sjoberg, Malmö (SE); Mauricio Torres, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 46 days.

(21) Appl. No.: 13/330,945

(22) Filed: Dec. 20, 2011

(65) Prior Publication Data

US 2013/0001337 A1 Jan. 3, 2013

(30) Foreign Application Priority Data

Dec. 20, 2010 (SE) ..... 1051348-9

(51) Int. Cl.
*B02C 15/10* (2006.01)
*B02C 4/32* (2006.01)

(52) U.S. Cl.
USPC ..... 241/37; 241/207

(58) Field of Classification Search
USPC ..... 241/37, 207–216
See application file for complete search history.

(56) References Cited

U.S. PATENT DOCUMENTS 3,372,881 A 3/1968 Winter
3,754,716 A * 8/1973 Webster ..... 241/208
4,016,630 A 4/1977 Bengtsson et al.
4,187,991 A 2/1980 Poli
5,725,163 A * 3/1998 Eloranta et al. ..... 241/33
2009/0095827 A1 4/2009 Posti et al.

FOREIGN PATENT DOCUMENTS

WO 87/05828 10/1987

OTHER PUBLICATIONS

Swedish Search Report for Application No. 1051348-9.

* cited by examiner

*Primary Examiner* — Faye Francis

(74) *Attorney, Agent, or Firm* — Morgan, Lewis & Bockius LLP

(57) ABSTRACT

The present disclosure relates to a method for operating a gyratory cone crusher as well as a hydraulic circuit suitable for carrying out the method. A crusher comprises an inner crusher shell and an outer crusher shell, which define a crusher gap, and the crusher gap size is maintained by means of a hydraulic cylinder, and, in case the hydraulic liquid pressure exceeds a pressure threshold, hydraulic liquid is evacuated from the cylinder to increase the crusher gap size. The method involves carrying out detection of a tramp iron processing condition, implying that matter which the crusher cannot process has enter the gap. If such a condition is detected, the pressure threshold is lowered during a period of time. This means that the crusher gap is opened quicker, such that the matter that cannot be crushed is removed from the crusher, which is thereby protected from potentially detrimental impacts.

12 Claims, 3 Drawing Sheets

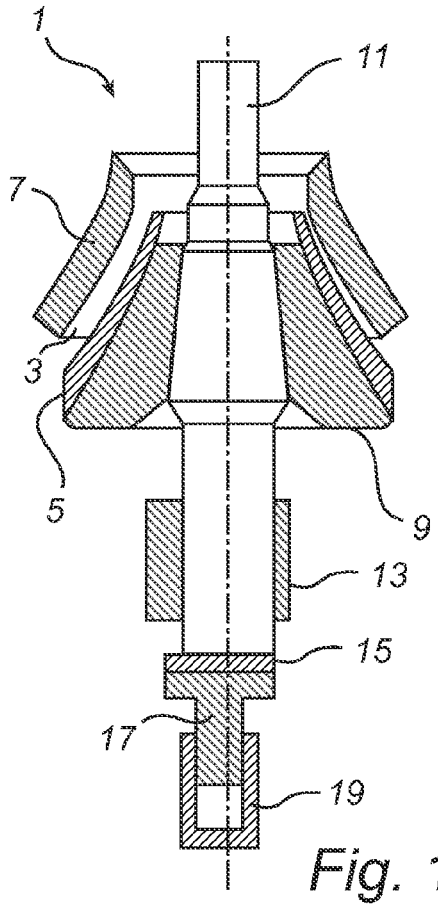
Fig. 1
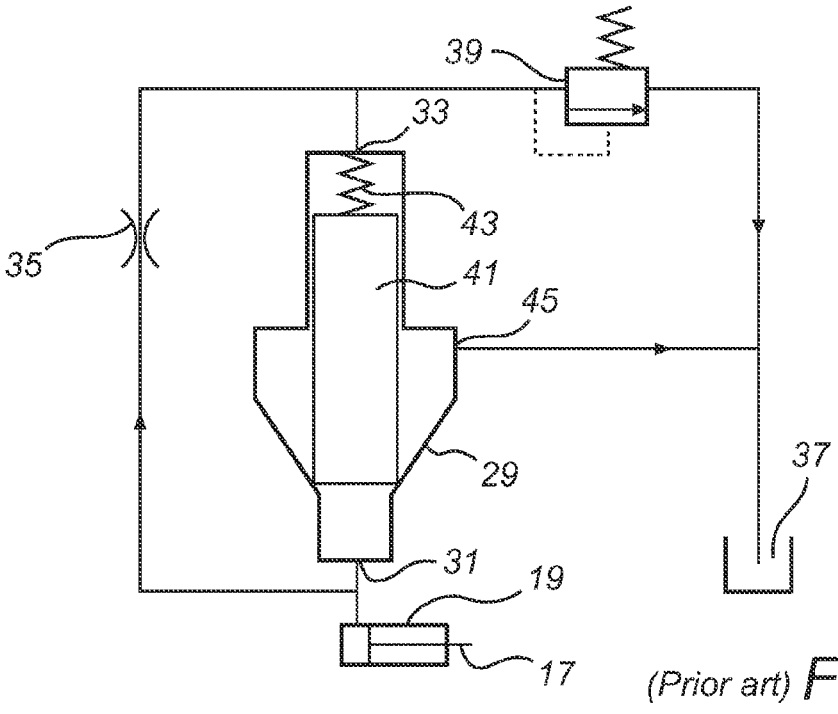
(Prior art) Fig. 2

HYDRAULIC CIRCUIT AND METHOD FOR CONTROLLING A GYRATORY CONE CRUSHER

RELATED APPLICATIONS

The present application claims priority to Swedish Application No. 1051348-9 (filed 20 Dec. 2010), the entire contents of which are incorporated herein by reference.

TECHNICAL FIELD

The present disclosure relates to method for operating a gyratory cone crusher, wherein the crusher comprises an inner crusher shell and an outer crusher shell, defining a crusher gap, wherein the crusher gap size is maintained using at least one hydraulic cylinder, and wherein hydraulic liquid is evacuated from the cylinder in case the hydraulic liquid pressure exceeds a pressure threshold. The present disclosure further relates to a hydraulic circuit for carrying out this method.

BACKGROUND

Such a method is disclosed in U.S. Pat. No. 5,725,163, and protects to some extent the crusher from excessive loads that may damage different parts of the crusher when a high-density tramp iron object such as an excavator tooth or a grinding ball enters the crusher. However, just slightly increasing the crusher gap will in most cases not be sufficient to remove the high-density object. This means that the crusher will experience a number of further impacts when attempting to crush the high density object during further gyrations. The combined effect of such further impacts may still damage the crusher shells or other parts of the crusher.

SUMMARY

One object of the present disclosure is to obtain a method and device that is capable of protecting a crusher in a more reliable way. This object is achieved by means of a method for operating a gyratory cone crusher, wherein the crusher comprises an inner crusher shell and an outer crusher shell, comprising defining a crusher gap, wherein the crusher gap size is maintained using at least one hydraulic cylinder, evacuating hydraulic liquid from the hydraulic cylinder in case the hydraulic liquid pressure exceeds a first pressure threshold, and detecting a tramp iron processing condition, and, if such a condition is detected, lowering said first pressure threshold during a period of time. The object is also achieved by means of a hydraulic circuit comprising a logic element which is arranged to evacuate hydraulic liquid from the cylinder in case the hydraulic liquid pressure exceeds a pressure threshold, means for detecting a tramp iron condition, and means for lowering said pressure threshold in case a tramp iron condition is detected.

More specifically, the disclosure involves a method for operating a gyratory cone crusher, wherein the crusher comprises an inner crusher shell and an outer crusher shell, defining a crusher gap. The crusher gap size is maintained using at least one hydraulic cylinder, and hydraulic liquid is evacuated from the cylinder in case the hydraulic liquid pressure exceeds a pressure threshold. The method involves detecting a tramp iron processing condition, and, if such a condition is detected, lowering said pressure threshold during a period of time. This means that an impact from a matter that cannot be crushed will open the crusher gap a lot more, such that the matter is flushed through the crusher gap quicker. At the same time, each impact from attempting to crush the matter will affect the crusher shells, etc less, since the crusher becomes more resilient.

The lowering of the pressure threshold may be maintained during a predetermined time or until the tramp iron detection fades.

Tramp iron processing detection may be carried out by detecting a detection pressure in the hydraulic cylinder, the detection pressure being higher than the normal pressure threshold. Alternatively, or in combination therewith, the monitoring of a threshold relating to the first order derivative of the hydraulic cylinder pressure may take place. Further alternatives for the tramp iron processing detection include the monitoring of sounds from the crusher or movements of the crusher's frame.

A warning signal may be generated when a tramp iron processing condition is detected.

A hydraulic circuit for carrying out the above indicated method includes means for detecting a tramp iron condition, and means for lowering the pressure threshold in case a tramp iron condition is detected.

In such a hydraulic circuit, a logic element may be used, and the pressure threshold, when a tramp iron condition is not detected, may be maintained by means of a pressure relief valve which connects the hydraulic cylinder to a reservoir via, in order, a first input of the logic element, a constriction, and a second input of the logic element. When the pressure threshold is exceeded, the pressure relief valve opens and the resulting flow through the constriction creates a comparative pressure difference at said first and second inputs, which opens the logic element and evacuates oil from the cylinder. The means for lowering the pressure threshold may include a directional valve, which is connected in parallel with the pressure relief valve.

Alternatively, both pressure thresholds may be set by a proportional pressure relief valve which is electronically controlled, and which connects the hydraulic cylinder to a reservoir via, in order, a first input of the logic element, a constriction, and a second input of the logic element.

BRIEF DESCRIPTION OF THE DRAWINGS

FIG. 1 shows a gyratory cone crusher where the crushing gap is controlled by vertically adjusting a shaft which carries an inner crushing shell.

FIG. 2 illustrates schematically a hydraulic circuit for a prior art tramp iron protection arrangement.

DETAILED DESCRIPTION

Figure 3:
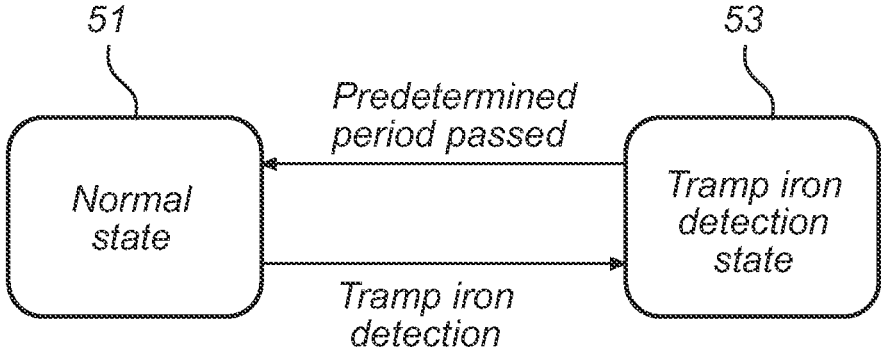
FIG. 3 shows a flow chart for a protection method.

FIG. 1 illustrates schematically and in cross section a gyratory cone crusher. In the crusher 1, material to be crushed is introduced in a crushing gap 3 formed between a first, inner crushing shell 5 and a second, outer crushing shell 7. The first crushing shell 5 is fixedly mounted on a crushing head 9, which is in turn fixedly mounted on a vertical shaft 11. The second crushing shell 7 is fixedly mounted on the frame (not shown) of the crusher 1.

The vertical shaft 11, the crushing head 9, and the first crushing shell 5 perform a gyrating movement. As a result of this movement, the crushing gap 3 is continuously reshaped.

The two crushing shells 5, 7 approach one another along one rotating generatrix and move away from one another along another, diametrically opposed, generatrix. Where, the crushing shells approach one another, material is crushed, and where the crushing shells move away from one another, new material is let into the crushing gap. Material to be crushed, i.e. ore, is fed to the grushing gap from above the crushing head 9.

An eccentric device 13 is rotatably arranged around the lower portion of the vertical shaft 11. A drive shaft (not shown) is arranged to rotate the eccentric device 13. The vertical shaft 11 is, at its upper end, carried by a top bearing (not shown) attached to the frame. When the eccentric device 13 is rotated, during operation of the crusher 1, the vertical shaft 11 and the crushing head 9 mounted thereon will perform the required gyrating movement.

The vertical shaft 11 is supported at its bottom end by a thrust bearing 15, which absorbs axial loads while allowing the gyration of the vertical shaft 11 as well as any rotation thereof.

The thrust bearing 15 is in turn supported by a piston 17 which allows the axial movement of the vertical shaft 11. Moving the shaft upwards, for instance, will reduce the overall width of the crushing gap 3, which implies a higher load and a more finely crushed output material. The piston 17 is positioned by changing the amount of hydraulic fluid in the hydraulic cylinder 19.

The present disclosure is related to means for protecting the crusher from tramp iron objects, which the crusher is unable to crush and which may damage the crusher shells and other parts of the crusher. Typically, a tramp iron object may be a steel grinding ball, a loose excavator tooth or the like.

In a crusher as illustrated in FIG. 1, some protection can be achieved by limiting the maximum hydraulic pressure in the cylinder 19, as will be described below. This means that, when a tramp iron object enters the crushing gap the resulting impact will remove some hydraulic fluid from the cylinder, thereby lowering the vertical shaft temporarily. This also limits the impact force on the crusher, and may thus to some extent protect the crusher, in particular the shells, from being damaged.

FIG. 2 illustrates schematically a hydraulic circuit for a prior art tramp iron protection arrangement. The arrangement may be connected to e.g. a hydraulic cylinder 19 carrying the vertical shaft as illustrated in FIG. 1. The protection arrangement includes a hydraulic logic element 29, which is connected to the hydraulic cylinder 19 at a first input 31. The first input 31 is connected to a second input 33 via a constriction 35. The second input 33 is connected to a reservoir 37 via a pressure relief valve 39, which is set to open when the pressure at the second input 33 of the logic element 29 exceeds a predetermined threshold pressure. The logic element 29 includes an internal cylinder 41, which is biased to a closed position by means of a spring 43. Further, a logic element output 45 is connected to the reservoir. In a state where the pressure in the cylinder 19 is less than the threshold pressure, e.g. 60 bar, of the pressure relief valve 39, the latter is closed and the two inputs 31, 33 of the logic element 29 receive the same pressure. The spring 43 keeps the internal cylinder 41 in the closed position such that no oil flows from the first input 31 to the output 45 of the logical element 29.

When a tramp iron element is introduced into the crusher, a high pressure spike occurs in the cylinder, and the pressure relief valve 39 opens such that some oil flows from cylinder 19 to the reservoir 37. Due to the constriction 35, the first input 31 of the logic element 29 will experience a considerably higher pressure than the second input 33 thereof. This pressure difference may cause the internal cylinder 41 to be displaced while compressing the spring 43, such that a channel is opened between the first input 31 and the output 45 of the logic element 29. Thereby, a considerably greater amount of oil is evacuated from the cylinder, and the crusher gap is opened to some extent. As soon as the crusher has gyrated past the tramp iron object, the logic element 29 is closed by the spring 43, since the pressure spike has then faded.

It should be noted that the crusher will still experience the impact almost in full, as the logic element, and consequently the opening of the gap, is comparatively slow. This means that pressure spikes may considerably exceed the pressure at which the pressure relief valve 39 is set to open the logic element. However, as the gap is opened to some extent, the tramp iron object is moved towards the end of the gap.

Despite this tramp iron protection feature, the crusher may still be damaged, since, even if the crushing gap is opened to some extent, a new impact will occur in the next gyration and a number of subsequent gyrations, each impact step-wise opening the crushing gap a bit more, until the tramp iron object passes through. In a normal case, 6-12 impacts may be experienced before a typical tramp iron object passes through the gap. Using a lower threshold is no viable solution to this problem, as a full amount of ore or stone being crushed provides a high pressure too, and such a pressure must be allowed without opening the crushing gap. If the threshold is too low, the gap may be opened by a full amount of material to be crushed, without any tramp iron presence. This of course impairs the crushing efficiency.

FIG. 3 shows a flow chart for a protection method. Briefly, the crusher system usually operates in a normal state 51. Upon detection of a tramp iron object, the crusher temporarily changes into a tramp iron detection state 53. Detection of a tramp iron object can be carried out in different ways as will be discussed later. The system remains in this state during a period of time and then reverts to the normal state 51. The duration of said period of time may be set by a timer, typically to a time corresponding to one or more gyrations, and optionally the timer may be reset in case a new tramp iron detection occurs, thereby prolonging the time in the tramp iron detection state.

While in the normal state, the crusher system operates similarly to the system illustrated in FIG. 2, i.e. if a pressure exceeding the pressure threshold occurs in the hydraulic cylinder, some fluid is removed from the cylinder. In this state the pressure threshold may be e.g. 60 bar.

While in the tramp iron detection state 53, the pressure threshold is considerably lowered, typically e.g. to 10 bar. This means that a following impact, which occurs e.g. when the crusher attempts to crush the tramp iron object, results in a comparatively greater widening of the crushing gap. Further, in this state, the weight of the bed of material to be crushed in the crusher may be sufficient to force the crushing gap to open, without awaiting the subsequent tramp iron impact. Thereby, the tramp iron object is quickly flushed through the crushing gap, and the risk of the crusher being damaged is substantially reduced. Typically only 1-5 impacts occur before the tramp iron object leaves the crushing gap. With a lower threshold, the crusher becomes more resilient which implies that each pressure spike will be lower, further reducing the risk of the crusher being damaged.

In other words, the system is capable of detecting a tramp iron processing condition, and if such a condition is detected the system's pressure threshold is lowered during a period of time. The tramp iron object quickly passes through the opening crushing gap, and subsequently, the crushing gap size is reset by pumping oil back into the cylinder.

In addition to opening the crusher gap, a warning signal (e.g. electronic or acoustic) may be generated. This signal may alert operating staff, such that the tramp iron object may be removed before being re-circulated into the crusher. Additionally, feeding of material to and from the crusher may be stopped or slowed, manually or automatically as a consequence of the warning signal.

There exist some alternative solutions for detecting a tramp iron condition.

To start with the pressure in the hydraulic cylinder could be monitored and compared with a second pressure threshold level, which is higher than the normal threshold level used in the normal state 51. Typically, a tramp iron object can cause a pressure peak exceeding 110 bar in a crusher of the type shown in FIG. 1.

Another option is to register the position of the plunger 17 in the cylinder and to detect rapid changes in position, probably caused by tramp iron impacts and thanks to the evacuation of hydraulic fluid from the cylinder by the circuit active in the normal state.

Another option still is to use the fact that a pressure peak caused by a tramp iron object will be very sharp compared to at normal crushing activities. Therefore, a high first order derivative of the hydraulic pressure, exceeding a threshold, can also be used to determine that a tramp iron object is present in the crusher.

A tramp iron object may cause the entire crusher to shake in a certain way, and also produces a characteristic sound. This implies that an accelerometer, mounted on the crusher frame, or a microphone, can produce data that may be useful to detect the presence of tramp iron objects. This data may conceivably be processed e.g. by means of a neural network which is trained to indicate the presence of a tramp iron object.

As the skilled person realizes there may exist further options, such as to use optical or magnetic sensors that are capable of detecting tramp iron objects in a flow of material to be crushed.

The skilled person realizes that the above schemes for detecting a tramp iron condition can be combined in different ways to provide detection with improved accuracy and reliability.

Figure 4:
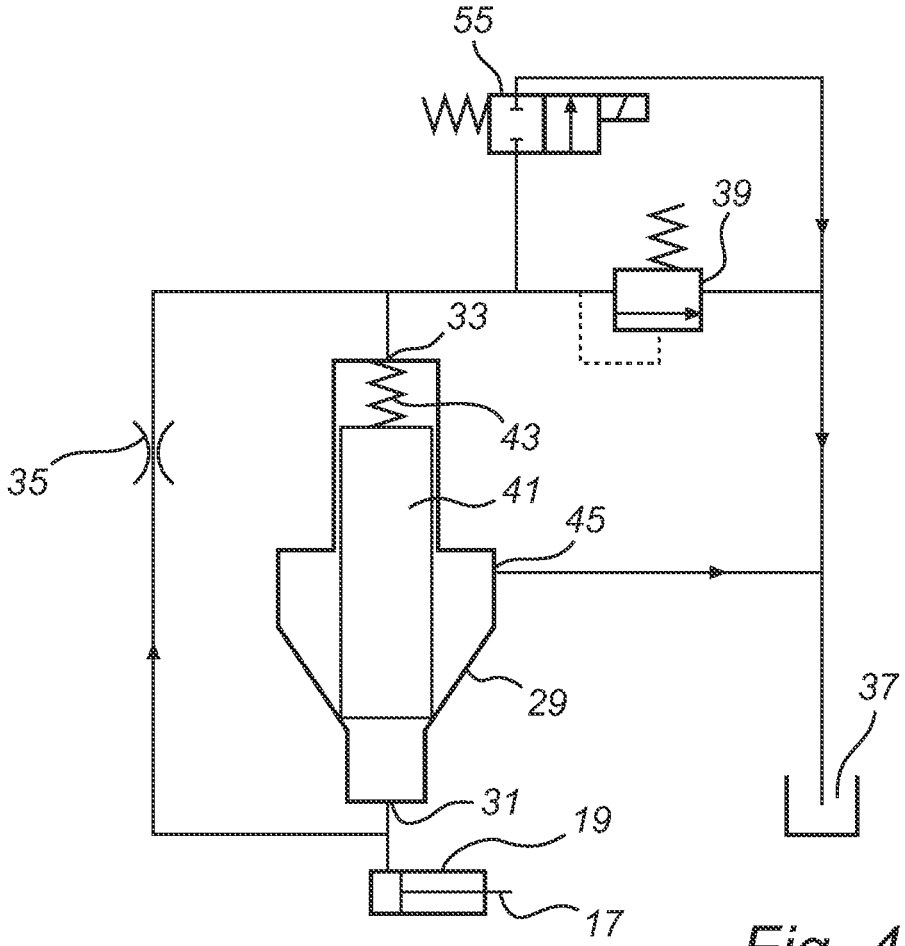
FIG. 4 illustrates a hydraulic layout according to the present disclosure.

FIG. 4 illustrates schematically a hydraulic layout according to the present disclosure which is a modification of the layout shown in FIG. 2. This circuit may operate on the hydraulic cylinder 19 of a crusher as shown in FIG. 1.

In addition to the hydraulic circuit, illustrated in FIG. 2, this circuit comprises a normally closed, electronically controlled solenoid directional valve 55. The directional valve 55 is activated as soon as the system enters the tramp iron detection state. When this happens, fluid is drained from the second input 33 of the logic element 29, such that only the spring 43 keeps the logic element closed. Therefore, a considerably lower pressure will trigger the evacuation of oil from the cylinder 19, resulting in a much quicker opening of the crusher gap, such that the tramp iron object is quickly removed from the system. The lower pressure threshold may be e.g. 8 bar, and is determined by the spring 43 in the logic element 29.

As compared to a system that opens the crushing gap 3 fully every time a tramp iron is detected, the loss of production in terms of crushed material may be low, as the crushing gap only opens as much as necessary. This is due to the fact that the lower threshold may be set to a level that is higher than the pressure obtained by the main shaft assembly (cf. 5, 9, 11 in FIG. 1).

Figure 5:
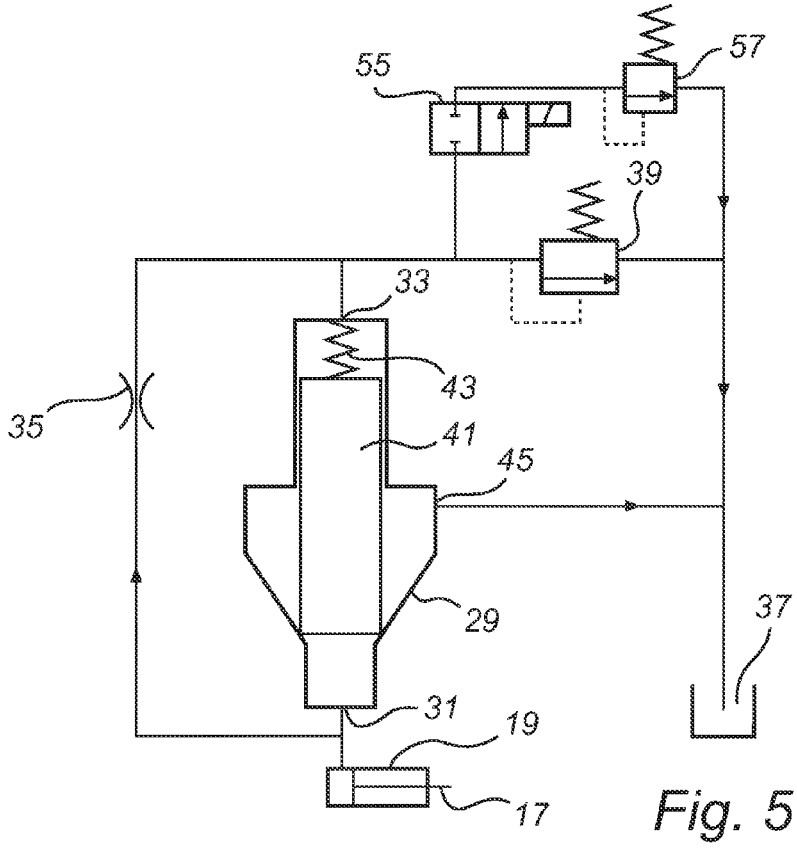
FIG. 5 illustrates a first alternative hydraulic layout.

FIG. 5 illustrates a first alternative hydraulic layout, which employs a second pressure relief valve 57, connected in series with the directional valve 55. The second pressure relief valve serves to increase the lower threshold, which is required to open the logic element 29 in the tramp iron detection state, as the lower threshold will in this case be determined by the sum of the pressures provided by the spring 43 and the second pressure relief valve 57, once the directional valve 55 is opened. This may cause a somewhat slower opening of the gap, as the second pressure release valve 57 will need some time to open. On the other hand, if the tramp iron condition is detected by measuring the cylinder's hydraulic pressure as is indicated as one option above, the first impact will occur in the normal state. The crusher employing the circuit of FIG. 5 will be more resilient at the first tramp iron impact, and the gap will open more initially, as a weaker spring 43 provides less resistance. In a circuit as shown in FIG. 6, the spring 43 can typically provide a pressure of 2 bar to the hydraulic circuit.

Figure 6:
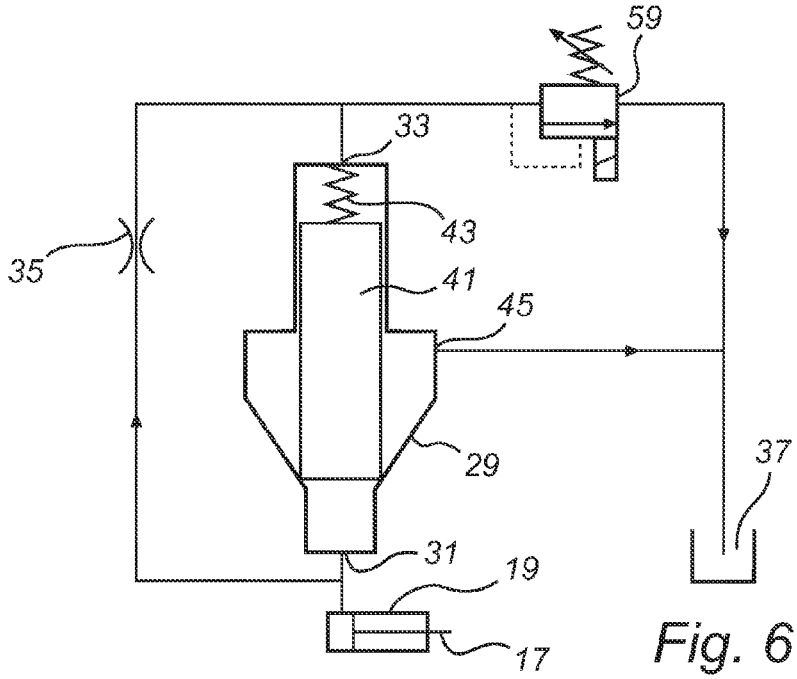
FIG. 6 illustrates a second alternative hydraulic layout.

FIG. 6 illustrates a second alternative hydraulic layout. This circuit employs a proportional pressure relief valve 59, which can perform the same function as the pressure relief valves 39, 57 and the directional valve 55 of FIG. 6. The higher threshold is set by an adjustable spring, and the lower threshold is applied by activating a solenoid on the valve when in the tramp iron detection condition state.

In summary, the present disclosure relates to a method for operating a gyratory cone crusher as well as a hydraulic circuit suitable for carrying out the method. A crusher comprises an inner crusher shell and an outer crusher shell, which define a crusher gap, and the crusher gap size is maintained by means of a hydraulic cylinder, and, in case the hydraulic liquid pressure exceeds a pressure threshold, hydraulic liquid is evacuated from the cylinder to increase the crusher gap size. The method involves carrying out detection of a tramp iron processing condition, implying that matter which the crusher cannot process has enter the gap. If such a condition is detected, the pressure threshold is lowered during a period of time. This means that the crusher gap is opened quicker, such that the matter that cannot be crushed is removed from the crusher, which is thereby protected from potentially detrimental impacts.

The invention is not limited to the above-described embodiments, and may be varied and altered in different ways within the scope of the appended claims. For instance, the above disclosure is related to a crusher where a vertical shaft assembly as a whole gyrates, and a crushing gap's average size is changed by adjusting the vertical position of the shaft. The disclosed concept may however be applicable to other cone crusher types.

The invention claimed is:

1. A method for operating a gyratory cone crusher, wherein the crusher comprises an inner crusher shell and an outer crusher shell, comprising:

defining a crusher gap, wherein the crusher gap size is maintained using at least one hydraulic cylinder;

evacuating hydraulic liquid from the hydraulic cylinder in case the hydraulic liquid pressure exceeds a first pressure threshold; and detecting a tramp iron processing condition, and, if such a condition is detected, lowering said first pressure threshold during a period of time.

2. The method according to claim 1, wherein the lowering of the pressure threshold is maintained during a predetermined time.

3. The method according to claim 1, wherein the lowering of the pressure threshold is maintained until no tramp iron is detected.

4. The method according claim 1, wherein the tramp iron processing detection is carried out by monitoring a detection pressure in the hydraulic cylinder against a detection pressure threshold, the detection pressure threshold being higher than the first pressure threshold.

5. The method according to claim 1, wherein the tramp iron processing detection is carried out by monitoring a threshold for the first order derivative of the hydraulic cylinder pressure.

6. The method according to claim 1, wherein the tramp iron processing detection is carried out by monitoring sounds from the crusher or movements of the crusher's frame.

7. The method according to claim 1, wherein a warning signal is generated when a tramp iron processing condition is detected.

8. A hydraulic circuit for operating a gyratory cone crusher, wherein the crusher comprises an inner crusher shell and an outer crusher shell, defining a crusher gap, wherein the crusher gap size is maintained using at least one hydraulic cylinder, the hydraulic circuit comprising:

a logic element which is arranged to evacuate hydraulic liquid from the cylinder in case the hydraulic liquid pressure exceeds a pressure threshold;

means for detecting a tramp iron condition; and means for lowering said pressure threshold in case a tramp iron condition is detected.

9. A hydraulic circuit according to claim 8, wherein the pressure threshold, when a tramp iron condition is not detected, is maintained by means of a pressure relief valve which connects the hydraulic cylinder to a reservoir via, in order, a first input of the logic element, a constriction, and a second input of the logic element, such that when the pressure threshold is exceeded, the pressure relief valve opens and the resulting flow through the constriction creates a comparative pressure difference at said first and second inputs, which opens the logic element.

10. A hydraulic circuit according to claim 9, wherein the means for lowering the pressure threshold includes a solenoid directional valve, which is connected in parallel with the pressure relief valve.

11. A hydraulic circuit according to claim 10, wherein a second pressure relief valve is connected in series with the solenoid directional valve.

12. A hydraulic circuit according to claim 8, wherein the pressure thresholds are set by a proportional pressure relief valve which is electronically controlled.

* * * * *